US006518693B1

(12) United States Patent
Meyer et al.

(10) Patent No.: US 6,518,693 B1
(45) Date of Patent: Feb. 11, 2003

(54) METHOD AND APPARATUS FOR MAGNETIC VOLTAGE ISOLATION

(75) Inventors: Steven D. Meyer, Snohomish, WA (US); David Q. King, Woodinville, WA (US)

(73) Assignee: Aerojet-General Corporation, Redmond, WA (US)

( * ) Notice: Subject to any disclaimer, the term of this patent is extended or adjusted under 35 U.S.C. 154(b) by 0 days.

(21) Appl. No.: 09/437,795

(22) Filed: Nov. 10, 1999

Related U.S. Application Data

(60) Provisional application No. 60/108,296, filed on Nov. 13, 1998.

(51) Int. Cl.[7] ..... H05H 1/00

(52) U.S. Cl. ..... 313/359.1; 315/111.01

(58) Field of Search ..... 313/359.1, 161, 313/231.31, 231.41

(56) References Cited

U.S. PATENT DOCUMENTS 4,838,021 A 6/1989 Beattie
4,862,032 A 8/1989 Kaufman
5,146,742 A 9/1992 Iida et al.
5,646,476 A 7/1997 Aston
5,763,989 A 6/1998 Kaufman
6,031,334 A * 2/2000 Meyer ..... 313/359.1

* cited by examiner

*Primary Examiner*—Vip Patel
*Assistant Examiner*—Joseph Williams
(74) *Attorney, Agent, or Firm*—Wiggin & Dana LLP; Gregory S. Rosenblatt; Michael K. Kinney

(57) ABSTRACT

A method and apparatus for using a magnetic field generated by a thruster magnet to control electron current emitted by a cathode assembly. The magnetic field reduces leakage current drawn by an inactive anode by producing a magnetic field in proximity to the inactive anode. This magnetic field increases the impedance to the anode for electron current which is produced in the cathode assembly. This reduction in leakage current reduces the amount of electron current produced by the cathode assembly. This control system can be implemented by connecting all thruster anodes and cathodes in parallel to an anode power supply.

10 Claims, 7 Drawing Sheets

METHOD AND APPARATUS FOR MAGNETIC VOLTAGE ISOLATION

CROSS REFERENCE TO RELATED APPLICATION

This patent application claims priority to U.S. provisional patent application serial No. 60/108,296 that was filed on Nov. 13, 1998. Provisional patent application serial No. 60/108,296 is incorporated by reference in its entirety herein.

BACKGROUND OF THE INVENTION

1. Field of the Invention

This invention relates to a method and apparatus for controlling electron current drawn by inactive thruster assemblies in a thruster system. More particularly, this invention relates to using thruster magnetic fields to control the electron current generated by an active cathode assembly of a thruster system and thereby reduces the amount of leakage current drawn by an anode of an inactive thruster assembly.

2. Description of the Art

Thrusters, such as Hall current thrusters and ion thrusters, are an effective mechanism to provide thrust for propulsion and stabilization of planetary or orbital satellites or spacecraft. One conventional way of implementing a thruster system is that each thruster operates from an isolated power supply. In these systems, each power supply is used to provide electrical current to an associated thruster. Since the outputs of the individual power supplies are isolated and can be turned on and off independently there is no problem with current leakage from unused thrusters since no voltage is applied to the unused thruster anodes. This design approach is inefficient since multiple power supplies require additional area and mass on a satellite or spacecraft. Area and mass are limited and, therefore, it is desirable to keep components as small as possible. The conventional implementation of multiple thruster spacecraft propulsion systems does not effectively reduce mass and area.

A conventional thruster system has the anodes of multiple thrusters connected in parallel without isolation switch devices and has the disadvantage that the anode of an inactive thruster draws electron current from active cathode assemblies. This leakage current, drawn by an inactive thruster, drains electron current from the active cathode assemblies and reduces the magnitude of electron current available to active thrusters. This leakage current forces the active cathode assemblies to generate additional electron current to compensate for the losses. The leakage current wastes potentially hundreds of watts of power and can also limit the current available to accelerate ions to produce thrust, thereby degrading system efficiency. It can also make the system totally inoperative since the leakage current can significantly exceed the normal current. This leakage current problem has prevented the direct parallel operation of thrusters in applications where only one thruster is used at a time.

A conventional approach, which attempts to solve the above leakage current problem, is to disconnect the unused thruster anode from the power source using a relay or transistor switch. In order to obtain the desired reliability, such a system may require a plurality of switches for fault tolerant isolation. A drawback to these switches is that they are susceptible to failure, which may prevent an anode from being turned "on" or turned "off" as desired. An uncontrolled anode can cause catastrophic failure of the entire thruster system, which can result in failure of the satellite or spacecraft. The added switch also adds to system cost. This is especially true if the switch must be a redundant configuration of multiple switches.

Some conventional thruster system patents are described as background. U.S. Pat. No. 4,862,032, issued to Kaufman et al. entitled "End-Hall Ion Source" discloses a gas used to produce a plasma that is introduced into a region defined within an ion source. An anode is deposed near one end of that region, and a cathode is located near the other. A potential is impressed between the anode and the cathode to produce electrons which flow generally in a direction from the cathode to the anode. These electrons bombard the gas to create plasma. A magnetic field is established within the region in a manner such that the field strength decreases in the direction from the anode to the cathode. This patent does not disclose utilizing magnetic fields to isolate inactive thruster anodes and thereby reduce leakage current from an active cathode assembly.

U.S. Pat. No. 4,838,021, issued to Beattie entitled "Electrostatic Ion Thruster with Improved Thrust Modulation" discloses an ion propulsion system that utilizes an ionizing system for ionizing a gaseous propellant within a chamber to produce a plasma. The ionizing system includes a cathode to provide a source of electrons and anodes to accelerate the electrons to velocities sufficient to ionize the gaseous propellant. An extraction system is used for expelling an ion beam from the plasma. A controller initiates the operation of the thruster by activating the thruster power processor, which in turns activates power supplies. This patent does not disclose using the magnetic field to control electron current and thereby reduce leakage current drawn by an anode that is not producing thrust. U.S. Pat. No. 4,838,021 is hereby incorporated by reference in its entirety herein.

U.S. Pat. No. 5,146,742, issued to Iida et al., entitled "Ion Thruster for Interplanetary Space Mission" discloses an ion thruster operable in an interplanetary space system with plasma generated by microwaves in a propellant atmosphere. A vessel defines first, second and third hollow spaces and a window between the first hollow space and the second and third hollow spaces. This ion thruster system does not disclose controlling an ion beam and reducing the leakage current drawn from a cathode assembly by an inactive anode.

As can be seen from the above discussion, conventional thruster systems are not capable of reliably and efficiently controlling anode activity nor are conventional thruster systems capable of preventing an inactive thruster from drawing leakage current from an active thruster. Therefore, the instant invention provides a simplified control system utilizing magnet fields for reliable control of electron current in inactive thrusters connected to a common power bus, thereby reducing the amount of leakage current drawn by an inactive anode. This reduction in leakage current allows operation of the thruster system without relying on mechanical or electronic switches to disconnect the inactive thrusters since nearly all of the electron current produced by a cathode assembly is available for useful operation of the thruster that provides useful thrust for the satellite or spacecraft. The parasitic leakage current that can, in many cases, prevent proper operation is completely eliminated.

SUMMARY

It is an object of the present invention to provide enhanced control of a thruster system. Accordingly, one embodiment is drawn to an apparatus for controlling an electron current including a system power supply and a first cathode assembly coupled to the system power supply for generating an associated electron current. A first thruster produces thrust, and has an associated anode and an associated propellant source. A second cathode assembly is coupled to the system power supply for generating an associated electron current when operating a second thruster. The second thruster produces thrust, and has an associated anode and an associated propellant source. A first magnetic device is associated with the first thruster for generating a first magnetic field and a second magnetic device is associated with the second thruster for generating a second magnetic field. The second magnetic field substantially inhibits the electron current produced by the first cathode assembly from reaching the second anode.

A second embodiment of the present invention is drawn to a method for controlling an electron current in a thruster system comprising the steps of:

generating an electron current in a cathode assembly;

discharging the electron current from the cathode assembly;

attracting a first portion of the electron current to an active thruster;

decoupling propellant flow from at least one inactive thruster;

generating a magnetic field associated with each of the at least one inactive thruster and thereby substantially repelling electron current flow to the at least one inactive thruster.

A third embodiment of the instant invention is drawn to a plasma current controlling apparatus. This apparatus has an anode power supply for supplying power to a thruster system. A cathode assembly is coupled to the anode power supply and receives power from the power supply. The cathode assembly produces an electron current. A plurality of thrusters, each of which has an anode, is coupled to the cathode assembly through the power supply. At least one of the thrusters is active and at least one thruster is inactive. Magnets are used to produce a magnetic field to control the electron current produced by the cathode assembly by presenting an impedance between inactive anodes and the electron current. This impedance repels leakage current drawn by an inactive thruster.

DETAILED DESCRIPTION OF THE INVENTION

Figure 1:
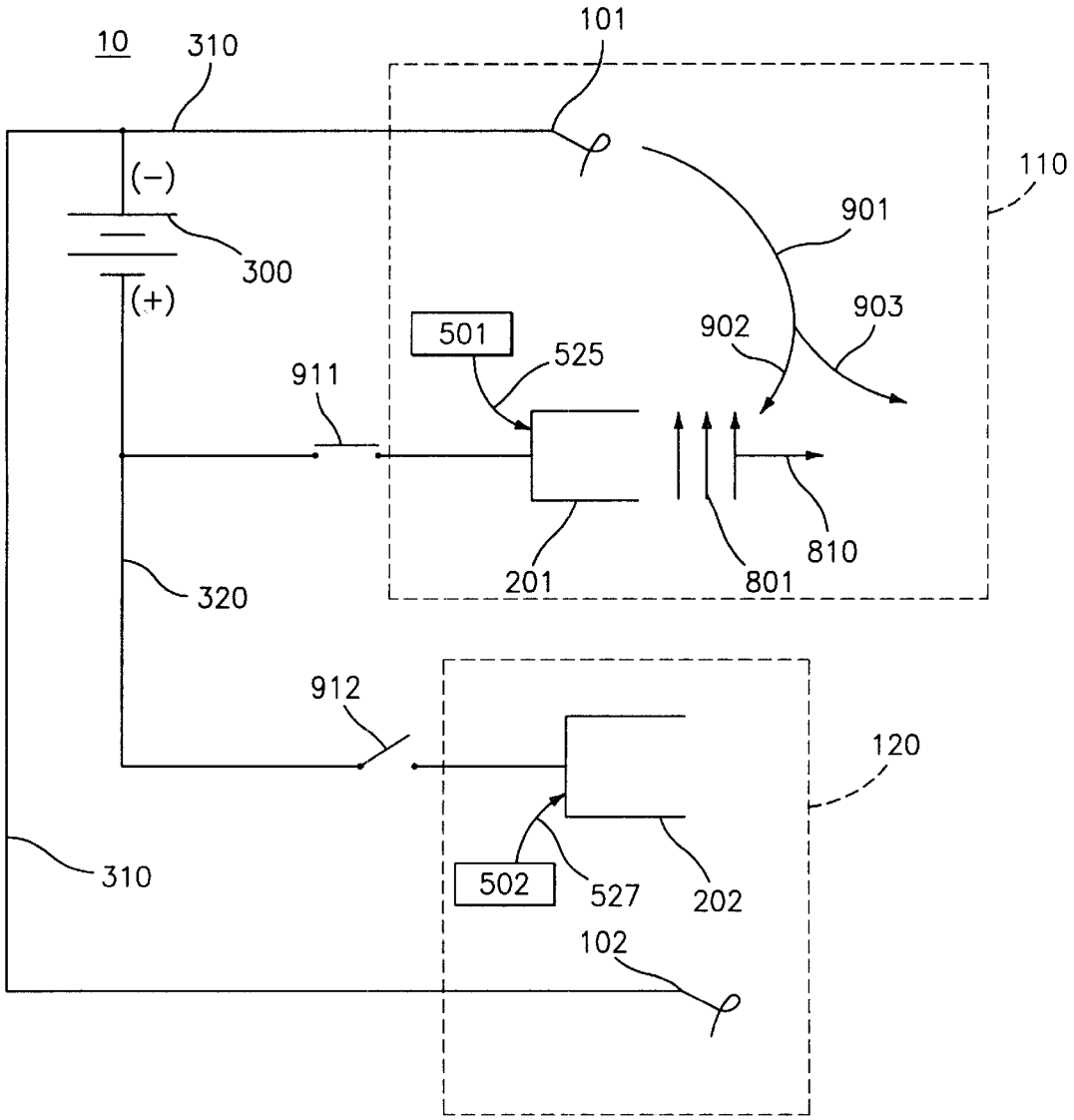
FIG. 1 (PRIOR ART)
FIG. 1 shows a conventional thruster control system utilizing switches as known from the prior art.

FIG. 1 shows system 10, which includes first cathode assembly 101, first thruster 201, propellant system 501 and magnetic field 801 that combine to form a thruster-cathode system 110. A similar thruster-cathode system 120 is shown in FIG. 1. Thruster-cathode system 120 includes second cathode assembly 102, second thruster 202 and propellant system 502. First cathode assembly 101 and second cathode assembly 102 are connected to the negative terminal of the anode power supply 300 via first wire 310. First thrusters 201 and second thrusters 202 are connected to the positive terminal of anode power supply 300 via second wire 320. This represents a conventional thruster control system in which first switch 911 and second switch 912 are used to control power to first thruster 201 and second thruster 202 respectively. When first switch 911 is in the closed or conducting position, electrical current flows from anode power supply 300 to first thruster 201. Electrons,.shown as first beam 902, from first cathode assembly 101, are suspended in a magnetic field 801 due to the Hall current effect. This creates an electric field between the anode 201 and the cloud of suspended electrons. Suspended electrons eventually fall through the magnetic field 801 after being accelerated by the electric field, ionizing propellant from first propellant system 501 that is received at first thruster 201 via first conduit 525. The ionized propellant ions are accelerated out of the first thruster 201 by a high electric field to produce a thrust beam 810. An additional portion of electron beam 903 joins the exiting ions to maintain charge neutrality. The action described is the fundamental mode of operation of Hall current thrusters. As shown in FIG. 1 when second switch 912 is in the open or the non-conducting state, electrical current is not provided to second thruster 202. Also, by terminating the propellant from second propellant system 502, the thruster cathode system 120 is non-operating. A drawback to this system is that second switch 912 may suffer a failure and thereby not properly disconnect second thruster 202 from anode power supply 300. If second switch 912 malfunctions in a failure to close mode, the operation of second thruster 202 would be prevented. If the second switch 912 fails in a failure to open mode, operation of first thruster 201 could be prevented because thruster electrons (shown as second beam 901) would be preferentially attracted to the anode (not shown) of second thruster 202. Depending on the plasma densities in space, the attraction of electrons to anode 202 may be so strong that anode power supply 300 may not be able to supply the necessary electrical current to power first thruster 201.

Figure 2:
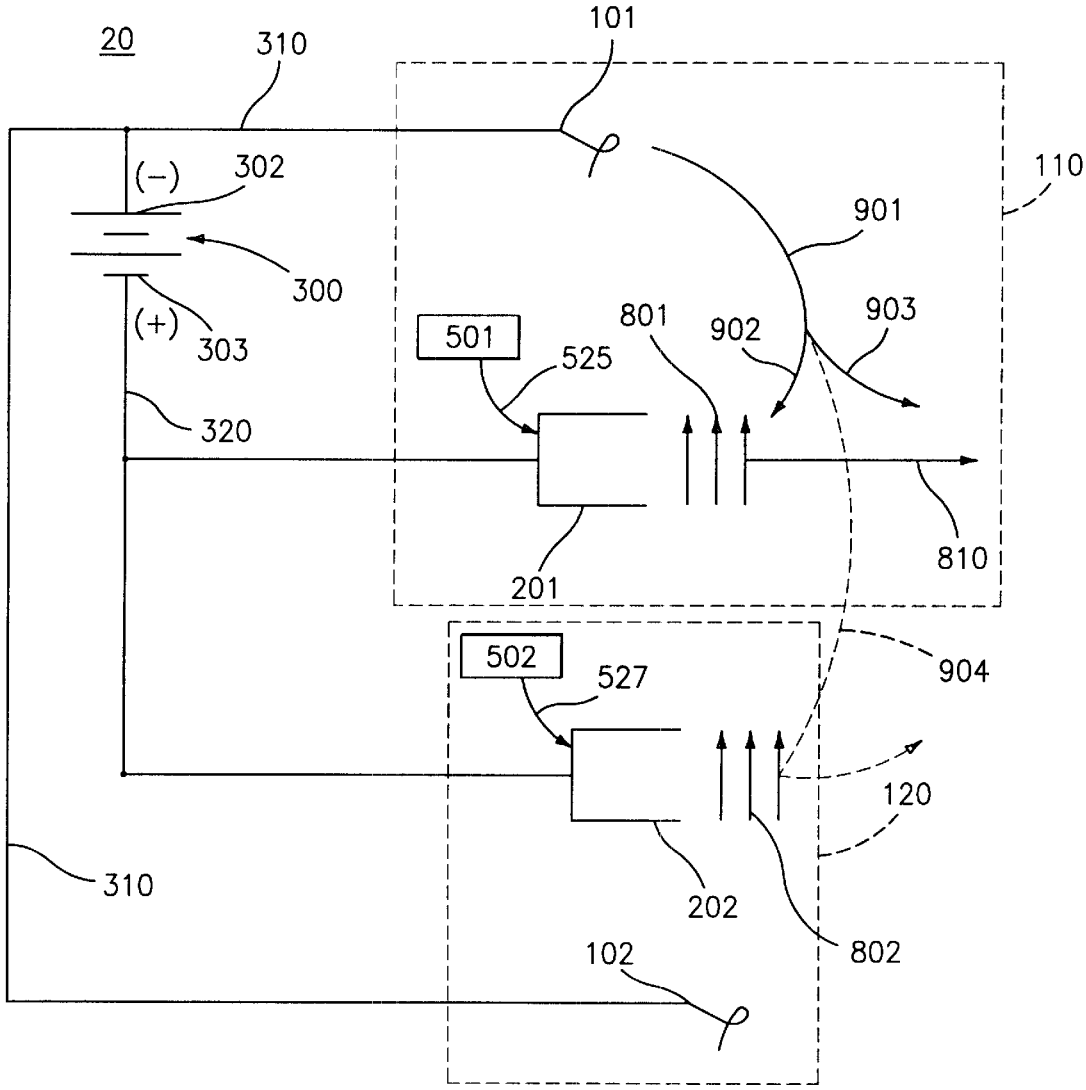
FIG. 2 shows a thruster control system in accordance with the instant invention that utilizes a magnetic field.

FIG. 2 shows a system 20, which is one embodiment of the present invention that is a thruster system comprising first cathode-thruster system 110 and second cathode-thruster system 120 and an anode power supply 300. A magnetic field associated with an inactive thruster repels leakage current from an active cathode. First cathode assembly 101 and second cathode assembly 102 are coupled to the negative terminal 302 of the anode power supply 300 via first wire 310. This first wire 310, is suitably a wire or any other interconnection means known in the.art. First thruster 201 and second thruster 202 are coupled to anode power supply 300 at the positive terminal 303 by second wire 320. Second wire 320 is suitably a wire, or any other interconnection means known in the art. First cathode assembly 101 produces second beam 901 that is attracted to the anode of first thruster 201. First thruster 201 is coupled to first propellant system 501, via first conduit 525, which supplies a propellant medium for expulsion as a propellant thrust 810. Magnetic field 801 is utilized to trap electrons from the electron beam 901. Magnetic field 801 depends on the design of system 20 and typically has a magnitude between approximately 0.005 Tesla and 0.2 Tesla and preferably about 0.02 Tesla (200 Gauss). The portion of the second beam 901 that is attracted to the first thruster 201 is shown as first beam 902. A portion of the second beam 901 shown as electron beam 903 is used to neutralize the thruster beam 810. Component 904 of second beam 901 is attracted to second thruster 202. Second thruster 202 is part of inactive thruster-cathode system 120. This inactive thruster-cathode system 120 has the potential for drawing the leakage current shown as 904. In order to prevent this leakage current, which wastes potentially hundreds of watts of power and could even be so large in magnitude that it could prevent operation of the system 20, magnetic field 802 is generated via system power supply (not shown). In most implementations the magnetic field structure and electromagnet coils (not shown) are the same as used for normal operation of the thruster. Separate redundant coils could be wound on the magnetic structure if desired. Magnetic field 802 presents a high impedance barrier that inhibits substantially all leakage current 904 that is drawn from second beam 901. The Magnetic field 802 depends on the design of system 20 and is typically greater than 30 Gauss and preferably greater than 40 Gauss. The magnetic field 802 causes a Hall current effect that discourages electrons from reaching the positive portion of the anode of second thruster 202. The repulsion of this leakage current enables the system 20 to be operational and unaffected by the presence of the anode of the unused second thruster 202 even though it is directly connected to the positive terminal 303. It should be noted that propellant system 502 is off, meaning that no propellant is flowing to second thruster 202. It should also be noted that no electron current is flowing from second cathode assembly 102 although the system is still applicable in a system with multiple cathodes.

While the above system 20 has been described in relation to a first and second cathode-thruster system 110, 120 it should be apparent to one of ordinary skill in the art that a plurality of such cathode-thruster systems could be utilized to further provide additional electron currents to a spacecraft or a satellite.

Figure 3A:
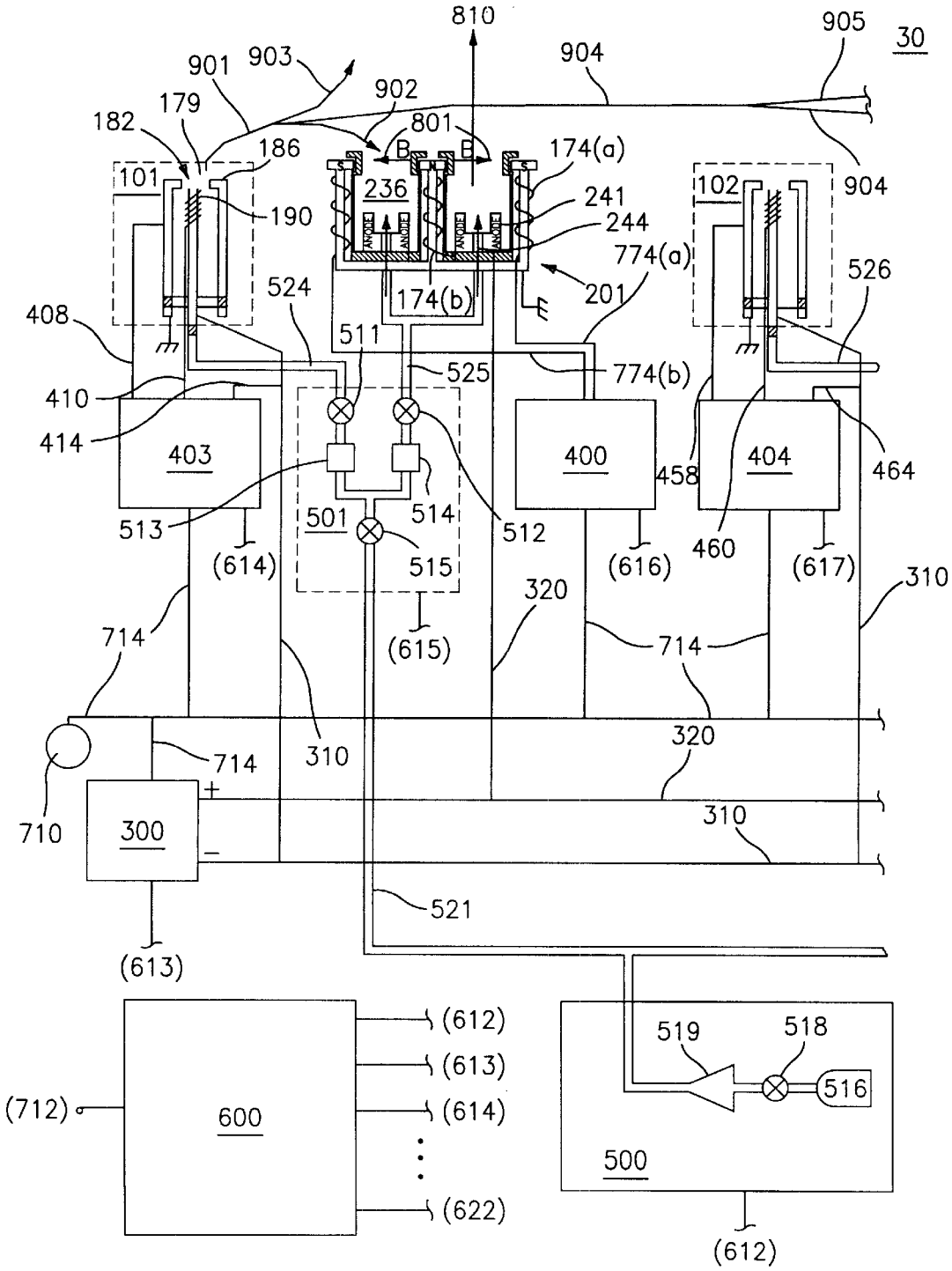
FIGS. 3A and 3B show a thruster system in accordance with one embodiment of the instant invention.
Figure 3B:
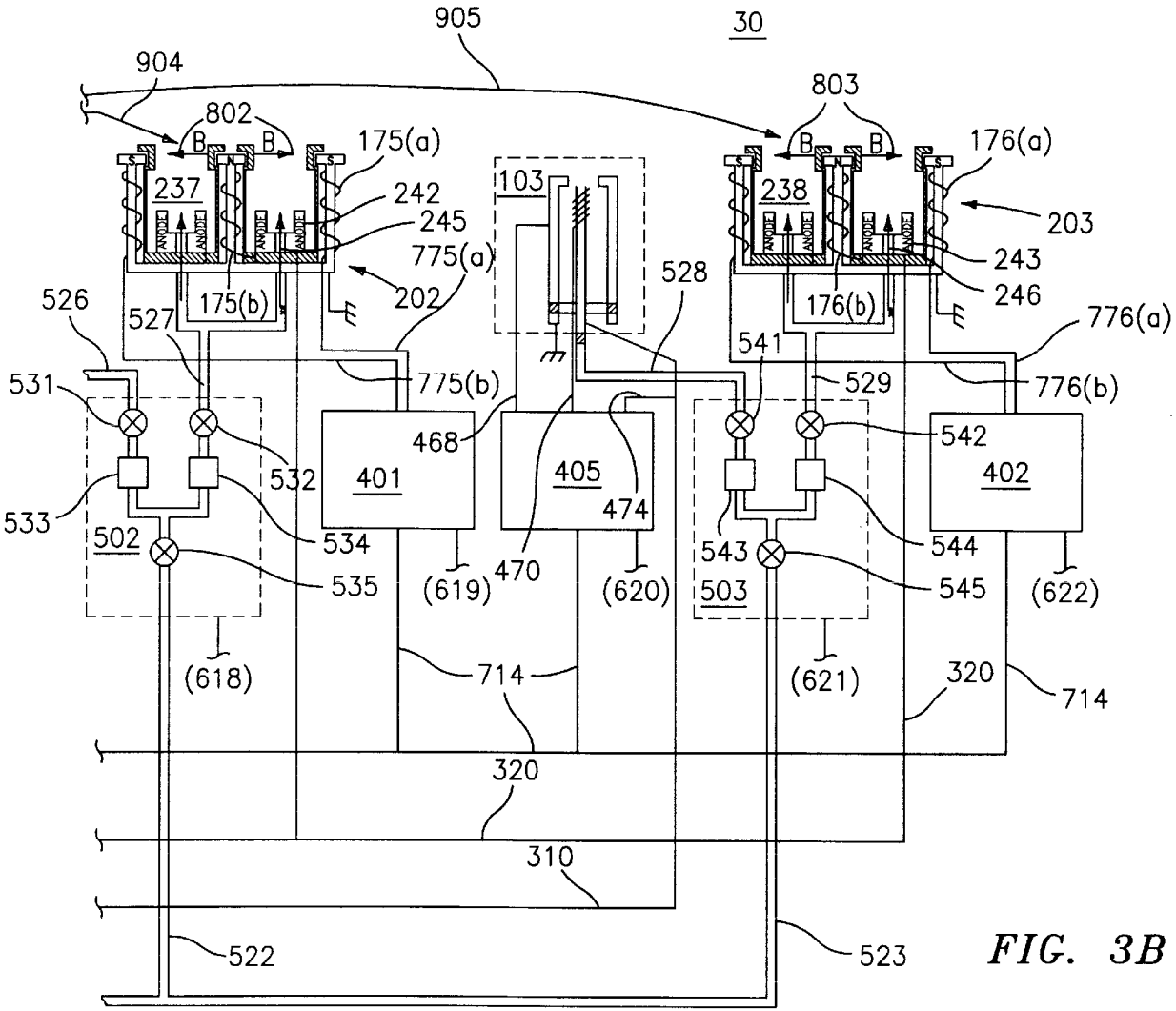

FIGS. 3A and 3B show a Hall current thruster system 30. System 30 is comprised a of cathode assemblies 101, 102, 103, a plurality of thrusters 201, 202, 203, an anode power supply 300, a plurality of magnet control circuits 400, 401 and 402, a plurality of cathode control circuits 403, 404, 405, and a propellant source system 500, coupled to a plurality of propellant systems 501, 502 and 503 capable of providing and metering propellant selectively to the thrusters 201, 202, 203 and cathode assemblies 101, 102, 103 as necessary, a thruster control circuit 600, and a system power source 710. FIGS. 3A and 3B also show a plurality of electrical interconnects 310, 320, 714, and 612 . . . 622 which are suitably wires or other connection means, between system 30 components.

The instant invention could be implemented in virtually any Hall current thruster system. One such environment for the instant invention is disclosed in U.S. patent application Ser. No. 08/984,895 filed Dec. 4, 1997 entitled "Cathode Current Sharing Apparatus and Method Therefor."

Cathode assemblies 101, 102 and 103 represent three cathode assemblies, however, system 30 could have as many cathode assemblies as can be supported by the system and the number of cathode assemblies is a design choice and is not critical for understanding the invention. Three are depicted in FIGS. 3A and 3B for descriptive purposes only. Only cathode assembly 101 will be described in detail. The described cathode is a hollow cathode type. Other cathode types could also be used. Additional cathode assemblies (i.e. 102, 103) have similar components.

Cathode assembly 101 consists of a cathode emitter 179, a cathode heater 190, and a keeper 186. The cathode assembly 101 has an orifice 182 for discharging a second beam 901. The cathode emitter 179, cathode heater 190 and keeper 186 are coupled to cathode control circuit 403, via interconnection means, such as wires, 408, 410 and 414 respectively, which distribute power received from system power source 710. Cathode control circuit 403 is responsible for heating the cathode assembly 101 and igniting a discharge which is normally sustained long enough to allow the first thruster 201 to be started and reach stable operation. It would also be possible to provide heater power, keeper power as well as the magnet power from a single power converter as described in U.S. patent application Ser. No. 09/143,294 filed Aug. 28, 1998 entitled "Method And Apparatus For Selectively Distributing Power In A Thruster System" which is hereby incorporated by reference in its entirety herein. In such a design, magnetic control circuit 400 and cathode control circuit 403 would be combined in a single circuit. Similarly, blocks 401 and 404 could be combined in a single circuit and magnet control circuit 402 and cathode control circuit 405 could be combined in a single circuit. It is apparent to those skilled in the art that the method of providing power to the elements of the cathode assemblies, 101, 102 and 103 and the magnets of the thrusters 201, 202 and 203 is a design choice and the cathode control circuit 403 and magnet control circuit 400 merely enable the proper voltages and currents to be supplied by system power source 710. In addition switching (not shown in FIGS. 3A and 3B) to allow sharing of the functions in magnet control circuit 400 and cathode control circuit 403 between different thrusters could also be used to improve system 30 tolerance to failures.

The cathode emitter 179 is suitably a hollow tube of material optimized for thermionic emission of electrons (shown as second beam 901). A gas, such as xenon, is passed through the tube to aid in the removal of electrons from the hollow tube. The cathode emitter 179 emits an second beam 901 through orifice 182 in the keeper 186.

The cathode heater 190 is used to raise the temperature of the cathode emitter 179 to stimulate electron emission. The cathode heater 190 is suitably wrapped around the cathode emitter 179 to effectively heat the cathode emitter 179.

The keeper 186 provides a selective barrier to protect the cathode emitter 179 and cathode heater 190 from damage from ions from the thrusters 201, 202, 203 and is used as a method to initiate emission of electrons (shown as second beam 901). The keeper 186 is provided with an electrical potential that is positive with respect to the cathode emitter 179. The keeper 186 draws electrons out of the cathode emitter 179 to initiate a first cathode assembly 101 discharge 901.

Thrusters 201, 202 and 203 represent three thrusters, however, system 30 may have as many thrusters as can be supported by the system 30. The number of thrusters is a design choice and is not critical for a description of the invention. Indeed, one of ordinary skill in the art will appreciate that the optimum number of thrusters depends on the design specifications of the system 30. Each thruster 201, 202, 203 has similar components and only first thruster 201 will be described in detail.

First thruster 201 has a ionization chamber 236, anode 241 and magnetic poles 174(*a*) and 174(*b*) for creating a Hall current force. The Hall current force is used to retard electron flow from cathode emitter 179 to anode 241. Electrons trapped by the Hall current due to the magnetic field 801 generated by magnets 174(*a*) and (*b*) cause the formation of an electric field that accelerates an ionized propellant provided to the ionization chamber 236 through a distribution system 244 in the anode 241. The magnitude of magnetic field 801 is typically between 0.005 Tesla and 0.2 Tesla and preferably about 0.02 Tesla.

The first cathode assembly 101 and the first thruster 201 receive a quantity of propellant, such as xenon, or any other gas that is ionizable within the desired parameters, from propellant source system 500. The propellant source system 500 provides propellant material to propellant systems 501, 502 and 503 via conduits 521, 522 and 523 respectively. Propellant source system 500 includes a storage source 516, and flow controllers 518 and 519. Propellant systems 501, 502 and 503 provide propellant to an associated cathode assembly 101, 102, 103 and associated thruster 201, 202, 203 as shown in FIGS. 3A and 3B. Each propellant system 501, 502 and 503 has similar components but only propellant system 501 will be described in detail. Propellant system 501 receives propellant from propellant source system 500 via conduit 521. Propellant system 501 has sets of valves and splitters, shown as elements 511, 512, and 515 that enable control of propellant to first cathode assembly 101 and first thruster 201. Propellant system 501 provides propellant to the first cathode assembly 101 via conduit 524 and propellant to first thruster 201 via conduit 525. Flow control circuits 513 and 514 may be a simple gas restrictor or a device that can actively regulate the flow such as a thermal throttle. The propellant source system 500 also will typically contain a flow controller 519 that reduces the gas pressure to a low pressure, for example between 20 and 40 psi. High-pressure valve 518 isolates the high-pressure propellant storage source 516. This high-pressure valve 518 may be a one time use valve such as a pyro valve (high-pressure squib valve) or could be a latch valve or holding type valve.

Propellant systems 501, 502 and 503 are capable of being turned off so that no propellant will flow to the associated thruster or cathode assembly. Commands to turn the propellant systems 501, 502, 503 "ON" and "OFF" are suitably generated by logic sequencing from a microprocessor, or dedicated logic. The logic sequencing could be by the spacecraft computer or directly by ground control. FIG. 3A shows thruster control circuit 600 with input 712 to provide the required commands to the thruster control circuit 600. Thruster control circuit 600 then outputs commands via wires 615, 618 and 621 to the propellant systems 501, 502 and 503 respectively.

Anode power supply 300 provides power to the thrusters 201, 202 and 203. Anode power supply 300 is coupled to thrusters 201, 202, 203 by interconnection means, which are shown as wire 320 in FIGS. 3A and 3B.

Electrical power is received by the thrusters 201, 202, 203 from the anode power supply 300 and used to charge the anodes of the respective thruster, specifically anodes 241, 242, 243. A portion of the anode power is also used by magnets 174, 175 and 176 if the magnets are electromagnets (the magnets each have 2 pieces, (a) and (b)).

Anode power supply 300 is suitably connected to the cathode assemblies 101, 102 and 103 through interconnection means, such as a wire, 310. The negative terminal of anode power supply 300 is coupled to cathode assemblies 101, 102, 103 to provide a discharge power path for the anodes 241, 242, 243 to a power return 714. Interconnection means 310 could be through additional elements, such as current sensor (not shown). The anode power supply 300 is also adapted to receive input 613 from thruster control circuit 600. Furthermore, anode power supply 300 is suitably coupled to the system power source 710 via power return 714 to receive power for the anodes 241, 242, 243 from system power source 710.

The cathode assemblies 101, 102, 103 receive electric current from the cathode control circuits 403, 404 and 405. First cathode assembly 101 receives power from cathode control circuit 403 through interconnection means, such as a wires 410, 408, and 414. The cathode control circuit 403 receives power from system power source 710 via power return 714 which represents both the power and its return. The cathode control circuit 403 also receives control signals via path 614 from thruster control circuit 600.

First thruster 201 also receives magnet power from magnet control circuit 400. This supply powers the magnet poles 174(*a*) and (*b*) that provide the magnetic field 801 for the operation of the first thruster 201. Usually a Hall current thruster has an inner electromagnet and several outer magnets coils. Magnet control circuit 400 receives power from system power source 710 via power return 714 which represents both the power and its return. This magnet control circuit 400 also receives control signals via path 616 from thruster control circuit 600. In some implementations the magnet current can be supplied by a single power converter that combines the function of magnet control circuit 400 and cathode control circuit 403 together as described in U.S. patent application Ser. No. 09/143294. In this case, circuits 400 and 403 would be combined together in a single circuit. In other applications, the normal operating magnet current would be provided by connecting the magnet coils in series with the discharge current. Thruster control circuit 600 is a control circuit for providing input to other subsystems of thruster system 30. Thruster control circuit 600 is, for example, a programmable microprocessor that is programmed to transmit preprogrammed control signals to the other subsystems in system 30.

Alternatively, thruster control circuit 600 is suitably configured to receive input via input 712 from another processor such as one located on the spacecraft (not shown) or one located at a remote location.

The thruster control circuit 600 provides signals via paths 616, 614, 617, 619, 620 and 622 to the magnet and cathode control circuits 400 403, 404, 401, 405 and 402 respectively. These signals can be used for example, by the magnet and cathode control circuits 403, 400, 401 and 402 to control the power distributed to the first cathode assembly 101, magnet poles 174(*a*) and (*b*), 175(*a*) and (*b*), and 176(*a*) and (*b*) respectively. Thruster control circuit 600 is also suited to provide control signals to the propellant systems 501, 502, 503 via wires 615, 618, and 621 respectively. This signal can control the amount of propellant provided to the thrusters 202, 203, 203 and/or the cathode assemblies 101, 102, 103 from the associated propellant system. Thruster control circuit 600 is also suited to provide control signals to the anode power supply 300 via input 613. These signals control how much power the anode power supply 300 provides to the anodes 241, 242, 243.

System power source 710 is connected to the anode power supply 300 and supplies power to other elements of system 30 via interconnector and power return 714. The system power source 710 is typically a positive supply with a magnitude of approximately 70 volts. Satellites commonly use power bus voltages from approximately 22 volts to 150 volts. The power return 714 is a voltage return for system power source 710.

First cathode assembly 101 generates second beam 901. A portion of first beam 902 is used to generate spin-stabilizing and propulsion thrust 810 from first thruster 201. Thrusters 202 and 203 are inactive. The propellant systems 502 and 503 receive input via wires 618 and 621 respectively to terminate propellant flow from propellant systems 502 and 503 to thrusters 202 and 203. Thus, propellant will not be transmitted through conduits 526, 527, 528 or 529, when thrusters 202 and 203 and cathode assemblies 102 and 103 are not operating. Propellant system 501 provides propellant via conduits 524 and 525 to first cathode assembly 101 and first thruster 201 respectively. The anode power supply 300 supplies anode power to anode 241 of first thruster 201 via wire 320 and provides a discharge path from the first cathode assembly 101 via interconnection means 310. Magnet control circuit 400 provides magnet current to magnetic poles 174(*a*) and (*b*) via supply 774(*a*) and return 774(*b*). This generates magnetic field 801.

Magnet control circuit 401 provides magnet current to magnetic poles 175(*a*) and (*b*) and magnet control circuit 402 provides magnet current to magnetic poles 176(*a*) and (*b*) via interconnections 775 and 776 respectively (775(*a*) and (*b*) and 776(*a*) and (*b*) represent the supply and return). This current is used by the magnets 175 and 176 to generate magnetic fields 802 and 803 respectively. These magnetic fields 802, 803 are used to cause a high impedance magnetic field barrier to leakage currents 904 and 905 that are attracted to thrusters 202 and 203. The magnitude of magnetic field 802 and magnetic field 803 is typically greater than 30 Gauss and preferably greater than 40 Gauss. Magnetic fields 802 and 803 repel substantially all of the leakage currents 904 and 905 thereby inhibiting leakage current from first cathode assembly 101 from reaching thrusters 202 and 203. This reduces the amount of electron current produced by first cathode assembly 101. Without this means of limiting electron current, it is likely that the leakage currents 904, 905 could be so large in magnitude as to prevent operation of first thruster 201.

While the above description describes first cathode assembly 101 and first thruster assembly 201 as being active and thrusters 202 and 203 being inactive, various combinations of active and inactive thrusters will be apparent to those skilled in the art.

Figure 4A:
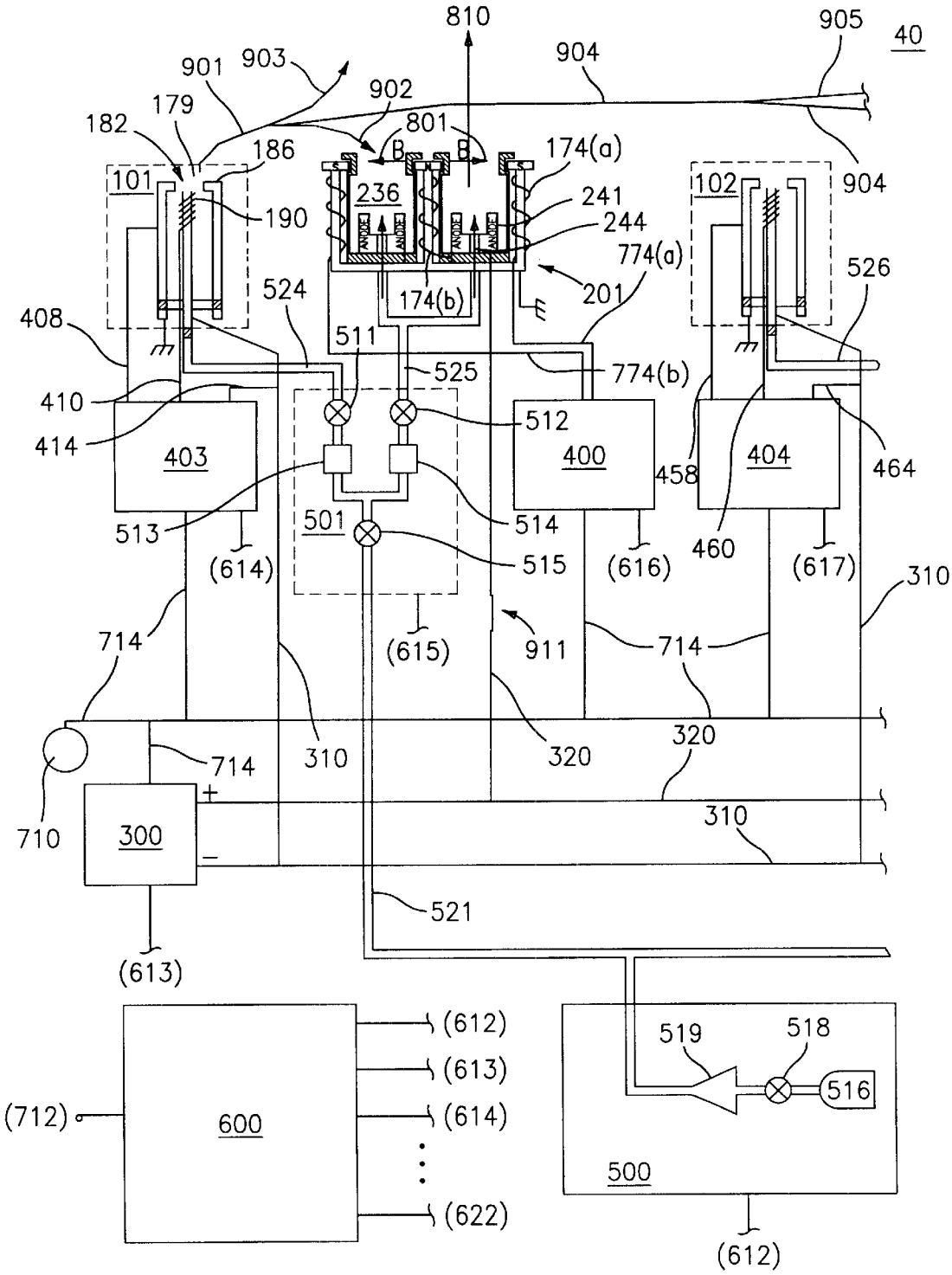
FIGS. 4A and 4B show a thruster system in accordance with a second embodiment of the instant invention.
Figure 4B:
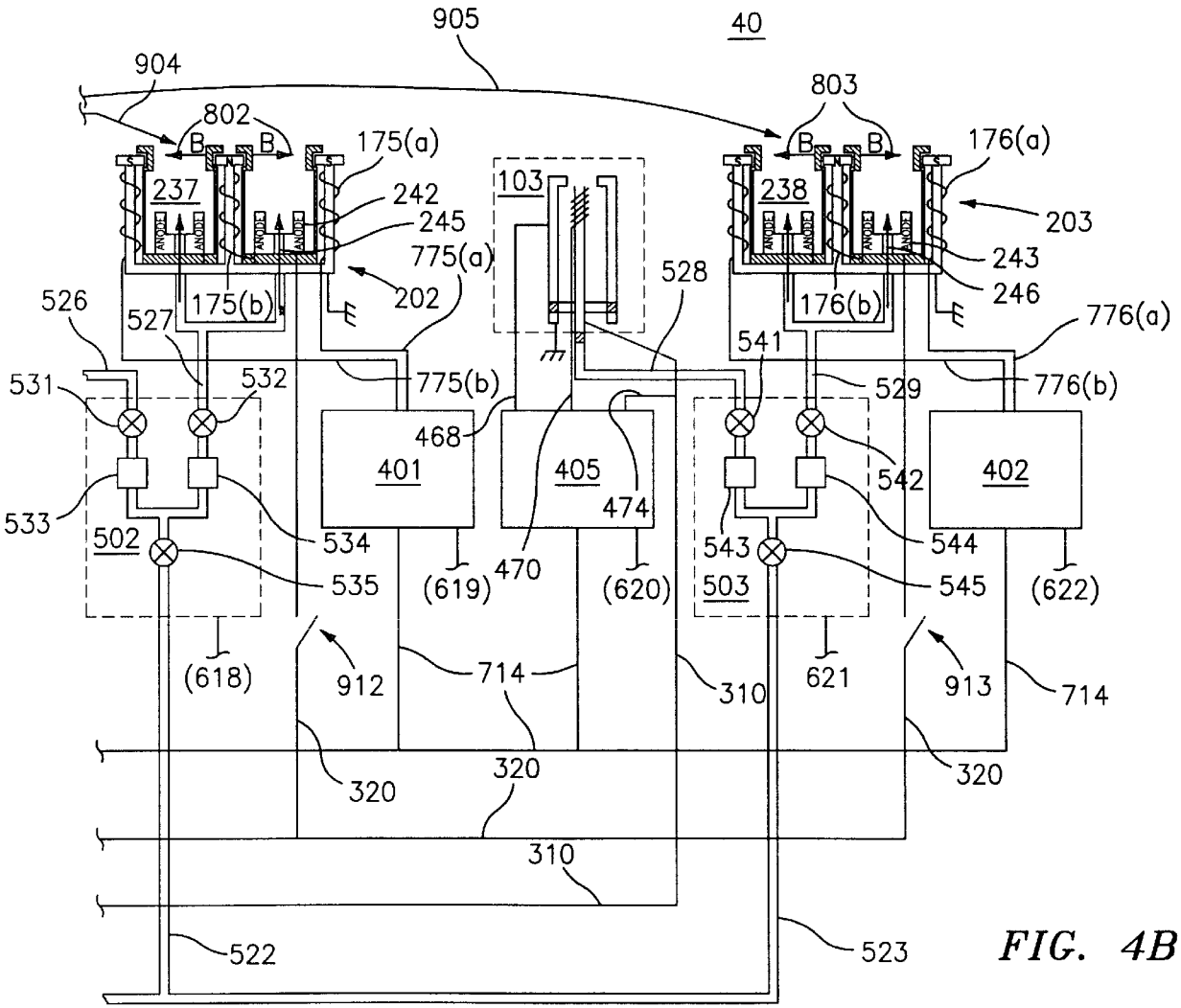

FIGS. 4A and 4B show a second embodiment of the invention shown in FIGS. 2 and 3. In this embodiment, the embodiment described in FIGS. 2 an more conventional switch isolation shown in FIG. 1. As in FIG. 1, the switch function could be implemented with electronic switching elements such as Bipolar transistors, Mosfet transistors or thyristors or with mechanical relays. The combined approach has advantages in that the switches allow isolation of a shorted thruster or wiring which the magnetic field isolation method cannot isolate. The magnetic isolation provides a second independent method of isolation that reduces the reliability requirements on the requirements for opening the switches. As shown in FIGS. 4A and 4B, anode power supply 300 is coupled to cathode assemblies 101, 102, 103 via interconnection means 310 from the negative terminal of the anode power supply 300. The anode power supply 300 is connected to thrusters 201, 202, 203 through switches 911, 912 and 913 respectively via wire 320 from the positive terminal of the anode power supply 300. Propellant systems 501, 502, 503 supply propellant to associated cathode assemblies and thrusters. FIGS. 4A and 4B show that the magnetic poles 174(*a*) and (*b*), 175(*a*) and (*b*) and 176(*a*) and (*b*) each generates a corresponding magnetic field 801, 802, 803 respectively. Each magnet may have several coils to form the magnetic fields.

Magnets 174, 175, 176 may be electromagnets which receive power from the power system power source 710 via the magnet control circuits 400, 401 and 402, and the associated supply and returns 774(*a*) and (*b*) 775(*a*) and (*b*) and 776(*a*) and (*b*). The magnetic fields 801, 802, 803 are selectively generated based on activity of thrusters 201, 202, 203 and the ability to control switches 911, 912 and 913. When a particular thruster is inactive, the anode can be isolated from electron current flow by the use of the switches or by applying a magnetic field. Opening the switch will break the electrical current flow to prevent electron current flow to the thruster anode from the space plasma. Applying a magnetic field to the thruster will cause a Hall current effect which will discourage electrons from reaching the thruster anode even if the series switch has failed in a closed state. In this manner two separate independent methods for reducing leakage current are provided. As seen in FIGS. 4A and 4B, first cathode assembly 101 and first thruster 201 are active. Switch 911 is in the closed or conducting state. First cathode assembly 101 generates second beam 901 that is drawn towards first thruster 201. Electron beam 903 of second beam 901 is drawn to neutralize a propulsion thrust 810 that is emitted from thruster 201. A first beam 902 is drawn into the electron cloud suspended above first thruster 201 by the Hall current affect caused by magnetic field 801. Portions of the election cloud will then fall into the ionization chamber 236 of first thruster 201 by the anode 241. The electron collisions with the propellant gas creates ions which are accelerated out of the first thruster 201 to provide propulsion thrust 810. A third potential portion of second beam 901 is leakage current 904, 905. Potential leakage currents 904 and 905 could be drawn from active first cathode assembly 101 to inactive thrusters 202, 203. This particular embodiment of the invention has two methods to prevent this leakage current flow. The first method is switches 912 and 913 which are in the open state. These switches could be relays or electronic switches or any other method of interrupting current flow. The second method is to use a magnetic field 802, 803 applied to the unused thrusters 202 and 203 to prevent current flow. In order to prevent leakage currents 904 and 905 from flowing to inactive anodes 242 and 243, magnetic fields 802 and 803 are generated to inhibit leakage current that is drawn to anodes 242 and 243. These magnetic fields are typically greater than 30 gauss and preferably greater than 40 Gauss. It is also a feature of the instant invention that propellant systems 502 and 503 will be shut off so that no propelling ions are being produced by thrusters 202 and 203. Without available propellant, the magnetic field of an inactive thruster inhibits leakage current to the anode of that thruster. Propellant gas molecules, such as xenon, have a positive charge and are therefore repelled by the positive charge on anode 242.

As shown in FIGS. 4A and 4B, switches 911, 912, 913 are used to increase the reliability of the control of thrusters 201, 202, 203. Switches 911, 912, 913 are suitably relays or other transistor-like devices. When in the closed, or conducting state, the switches conduct anode current to an associated thruster. When in the open, or non-conducting state, the switches produce an open circuit between the anode power supply and the associated thruster. As shown in FIGS. 4A and 4B, switch 911 can be closed or in the connecting state and switches 912, 913 are in the open state to prevent anode current from flowing to the inactive thrusters 202 and 203. These switches provide additional redundancy for the shut-off of inactive thrusters 202 and 203. Also as shown in FIGS. 4A and 4B, the cathode assemblies 101, 102, 103 are suitably connected in parallel with thrusters 201, 202 and 203.

One method of powering the magnets in a fault tolerant mode would be to power the inner and outer thruster magnets from separate power sources (not shown). The magnetic field from the inner and outer magnets would need to be of sufficient magnitude to reduce the current flow from the cathode assemblies 101, 102, 103 to the associated anode 241, 242, 243 respectively to a tolerable level, such as 10 mA. This can usually be achieved with much less than the full magnet current.

Figure 5:
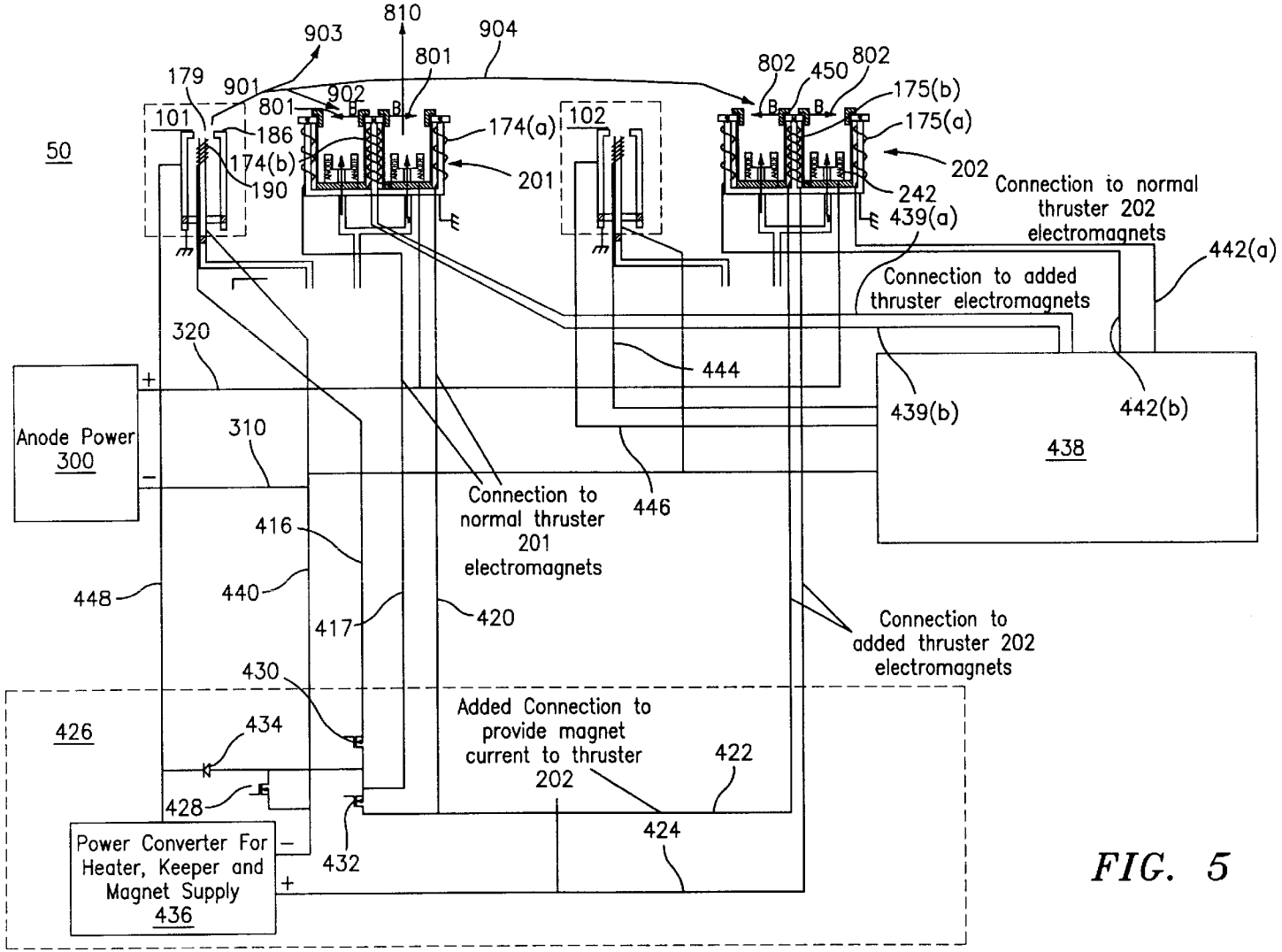
FIG. 5 shows a thruster system in accordance with a third embodiment of the instant invention.

The thrusters 201, 202, 203 could also be fitted with a separate magnet coil that is powered by currents from the operation of another thruster. This would allow the magnetic field necessary for leakage current control to be generated by currents from the operation of another thruster. This would reduce the possibility that a single failure would both prevent operation of the thruster and also prevent application of the magnetic field necessary for preventing current flow in the off mode. This approach would be especially useful for thrusters pairs that are not being used at the same time. This approach could be combined with the approach described in U.S. patent application Ser. No. 09/143,294. A method to accomplish this is shown in FIG. 5. There are other variations of this approach that will be apparent to those skilled in the art. In this example, the current used for the operation of the cathode keeper 186 via wire 416 and magnetic poles 174(*a*) and (*b*) of first thruster 201 via wires 417 and 420 is also passed through an added winding 450 on second thruster 202 via wires 422 and 424. This added winding 450 could typically be less turns than the normal magnet windings for normal operation of second thruster 202 and in most cases would not need to be on all of the magnetic pole pieces. For example an added winding on only the inner pole could be used or only an added winding on the outer pole pieces. Operation of the switches 428, 430 and 432 inside the combined heater, keeper and magnet supply, 426 is as described in U.S. patent application Ser. No. 09/143,294.

As shown in FIG. 5, the connections to another magnet coil have been added to each thruster. The current for operating cathode keeper 186 and magnets 174(*a*) and (*b*) are routed through the added winding on second thruster 202. In this manner whenever first thruster 201 is operating or starting up, a magnetic field 802 is applied to second thruster 202 to inhibit anode 242 from attracting electrons. Typical operation is first to preheat the cathode heater 190 of cathode assembly 101 to prepare for operation of first thruster 201. This is accomplished by having switches 430 and 432 in a conducting state to allow current from power converter 436 to be supplied to the cathode heater 190. In this mode anode power supply 300 is normally operated to produce a constant output current. After the cathode heater 190 is hot, switch 430 is opened and current is allowed to flow into the keeper 186 of first cathode assembly 101. In this mode current is flowing through cathode added bias winding 450 of second thruster 202 through switch 432 and diode 434 through keeper 186 to cathode emitter 179 and back to power converter negative terminal through the cathode emitter wire 440. This assumes one side of the heater 190 is tied to the cathode emitter 179 in the first cathode assembly 101. In this mode the keeper 186 is ignited by a high voltage supplied from the power converter 436. The current to operate the keeper 186 is flowing through the magnet 175 of second thruster 202 but not through the magnets 174 of first thruster 201. To start first thruster 201, power is applied from anode power source 300. Initially, magnet power for first thruster 201 is bypassed by switch 430. Upon sensing discharge current in first thruster 201, magnet current is applied to first thruster 201 by opening switch 432. This allows first thruster 201 to enter Hall current operation mode. Note that second thruster 202 has had magnet current applied to the added bias winding 450 during this time. This causes electrons to be captured by the magnetic field 802 and repelled from the anode 242 due to the Hall current effect.

A similar configuration is shown by supply 438 which provides for normal operation of second thruster 202 and a current for inhibiting leakage currents to first thruster 201. This configuration is especially useful where a system has two thrusters that are not used at the same time. In some applications the redundant method of supplying magnetic bias would provide adequate system fault tolerance without the necessity of adding additional switches to the anodes as shown in FIGS. 4A and 4B. If power supply 436 were to malfunction, supply 438 could be used to keep first thruster 201 from operating by introducing a magnetic field 801 to first thruster 201 via wires 439(*a*) and (*b*). Thus, the embodiment shown in FIG. 5 facilitates control of a first thruster 201 in the situation in which the power supply 436 for first thruster 201 malfunctions by enabling another power converter 436 to generate a magnetic field 801 for first thruster 201. This control feature is suitably implemented by controlling either the inner or outer poles; or both poles of the magnet.

While this invention has been described using a single anode power supply, it could also be practiced with a plurality of anode power supplies. The anode power supplies could be connected to each cathode-thruster assembly.

While this invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. An electron current controlling apparatus, comprising:

a system power supply;

at least one cathode assembly coupled to said system power supply for producing and discharging said electron current;

a plurality of thruster assemblies coupled to said system power supply, each of said thruster assemblies having an associated anode and an associated source of propellant;

an anode power supply coupled to each of said at one cathode assembly and to each of said anodes; and a magnetic device associated with each of said thruster assemblies for selectively generating a magnetic field in proximity to an associated one of said thruster assemblies for substantially repelling electron leakage current;

wherein said magnetic device includes a plurality of coils allowing for connection of each of said coils to an independent source of electron current, said independent source of electron current to any one of said coils is separate from any other source of electron current such that at least one coil of said magnetic device associated with a first thruster assembly is connected to an independent source of electron current that is associated with a second thruster assembly.

2. The apparatus as claimed in claim 1 wherein said magnetic device is selected from a group consisting of electromagnets and permanent magnets.

3. The apparatus as claimed in claim 2 wherein said anodes and each of said at least one cathode assembly are connected in parallel.

4. The apparatus as claimed in claim 2 further comprising a plurality of anode power supplies, each of said anode power supplies coupled to an associated anode and said cathode assembly.

5. The apparatus as claimed in claim 1 wherein said magnetic device further comprises:

an inner pole;

an outer pole;

a first power source for providing power to said inner pole, and a second power source for providing power to said outer pole.

6. The apparatuse as claimed in claim 1 further comprising:

a plurality of cathode assemblies each of said plurality of cathode assemblies coupled to a negative terminal of said anode power supply.

7. The apparatus as claimed in claim 1 further comprising:

a command circuit coupled to said anode power supply and coupled to said propellant sources for controlling propellant flow from said propellant sources to said thrusters.

8. The apparatus as claimed in claim 1 further comprising:

a power control circuit coupled to said magnetic device for selectively providing power to said plurality of coils.

9. A method of controlling an electron current, comprising:

emitting the electron current from a cathode assembly;

providing a plurality of thruster assemblies, at least one of the plurality of thruster assemblies being inactive;

selectively generating, with a plurality of coils, a magnetic field associated with the at least one inactive thruster assembly to increase electrical impedance to the electron current, each of the plurality of coils connected to an independent source of electron current such that at least one coil associated with a first of the thruster assemblies is connected to an independent source of electron current that is associated with a second of the thruster assemblies; and repelling electron flow to the at least one selected inactive thruster assembly.

10. The method as claimed in claim 9, further comprising:

connecting the cathode assembly and the plurality of thruster assemblies in parallel.

* * * * *